US011291281B1

(12) United States Patent
White

(10) Patent No.: US 11,291,281 B1
(45) Date of Patent: Apr. 5, 2022

(54) ROLL-ABOARD GARMENT BAG

(71) Applicant: Layla Rose White, Lake Villa, IL (US)

(72) Inventor: John M. White, Hayward, CA (US)

(73) Assignee: Layla Rose White, Lake Villa, IL (US)

( * ) Notice: Subject to any disclaimer, the term of this patent is extended or adjusted under 35 U.S.C. 154(b) by 0 days.

(21) Appl. No.: 17/451,796

(22) Filed: Oct. 21, 2021

(51) Int. Cl.

| | |
|---|---|
| ***A45C 5/14*** | (2006.01) |
| ***A45C 7/00*** | (2006.01) |
| ***A45C 13/03*** | (2006.01) |
| ***A45C 13/26*** | (2006.01) |
| ***A45C 5/08*** | (2006.01) |
| ***A45C 13/10*** | (2006.01) |

(52) U.S. Cl.
CPC ..... *A45C 7/0054* (2013.01); *A45C 5/08* (2013.01); *A45C 5/14* (2013.01); *A45C 13/03* (2013.01); *A45C 13/103* (2013.01); *A45C 13/262* (2013.01); *A45C 2013/267* (2013.01)

(58) Field of Classification Search
CPC ..... A45C 7/0004; A45C 5/08; A45C 13/03; A45C 13/262; A45C 3/004; A45C 5/14; A45C 2013/267; A45C 7/0054; A45C 13/103
USPC ..... 190/18 A
See application file for complete search history.

(56) References Cited

U.S. PATENT DOCUMENTS

| | | | | |
|---|---|---|---|---|
| 2,254,578 | A * | 9/1941 | O'Brien | A45C 7/0077 190/107 |
| 3,944,032 | A * | 3/1976 | Samhammer | A45C 5/06 206/292 |
| 4,738,360 | A | 4/1988 | King et al. | |
| 5,113,982 | A * | 5/1992 | Pulichino | A45C 3/004 190/109 |
| 5,253,739 | A | 10/1993 | King | |
| 5,566,797 | A * | 10/1996 | Van Himbeeck | A45C 3/004 190/102 |
| 6,334,519 | B1 * | 1/2002 | Tong | A45C 3/00 190/107 |
| 2006/0266603 | A1 * | 11/2006 | Godshaw | A45C 3/004 190/108 |

* cited by examiner

*Primary Examiner* — Sue A Weaver
(74) *Attorney, Agent, or Firm* — Patterson + Sheridan, LLP

(57) ABSTRACT

A roller garment bag is disclosed that combines and integrates a carry-on and a garment bag into a single luggage case, which obtains the desirable conveniences of carry-on luggage while retaining all of the desirable aspects of a garment bag and a carry-on without introducing any significant detriments to the individual advantages of each style of luggage bag by itself.

20 Claims, 14 Drawing Sheets

ROLL-ABOARD GARMENT BAG

BACKGROUND OF THE INVENTION

The present invention relates to luggage, and particularly to a garment luggage bag with wheels and a handle so that it may be rolled aboard commercial passenger aircraft, among other uses.

BACKGROUND OF THE INVENTION

One type of luggage is generally referred to as a carry-on case, also known as a carry-on bag. A carry-on bag is a moderate to small sized bag having a generally rectangular configuration and a size which allows the bag to be inserted in the space below a commercial aircraft passenger seat or in a commercial aircraft overhead compartment. A common feature of carry-on style luggage cases is the use of wheels and a guide handle to allow a traveler to maneuver the case on its wheels rather than carry the luggage case by hand. One pair of wheels is positioned along a bottom edge of the luggage case. The guide handle is collapsible to allow the luggage case to fit within the size restrictions of the major commercial airlines' requirement for carry-on bags and extendable from it to be useable to lever the case onto the wheels and to pull the case. The wheel and guide handle configuration provides good stability, maneuverability and control of the case.

A carry-on style luggage case allows the user to obtain the important advantages of avoiding the delay and inconvenience of checking the luggage and the risk of losing the luggage. By incorporating wheels on the carry-on style luggage case, the user obtains the important advantage of easy transportation by rolling the case on its wheels, thereby avoiding the more strenuous effort of carrying the luggage case by hand. U.S. Pat. No. 5,253,739 discloses an example of a carry-on style luggage case with wheels and a guide handle.

Another type of luggage is a garment bag. A garment bag allows articles of clothing such as shirts, blouses, jackets, suitcoats, trousers, dresses, skirts and coats to be quickly packed in the bag on hangers. With the clothing on hangers, the garment bag can then be closed and, in so doing, reshaped to make it easier to carry and to fit in the allowed aircraft compartments described previously. It is desirable that the clothing is confined in the garment bag in a manner which minimizes wrinkling. At the traveler's destination, the garment bag is unfolded, suspended from a closet bar or door, and the clothes may be thereafter taken directly from the garment bag for use and replaced in the garment bag after use. The garment bag can thereby be kept in a state of readiness without having to pack and unpack it at each destination. An example of a garment bag is found in U.S. Pat. No. 4,738,360.

In the past, attempts have been made to obtain the advantages of wheeled luggage by incorporating wheels and a guide handle with traditional garment bags. These attempts have generally involved attaching a relatively cumbersome and heavy structure to the outside of an otherwise common garment bag. Some of these structures have incorporated extendable supports which require the garment bag to be unfolded and connected to the extendable supports before the bag can be moved on its wheels. Unfortunately, the addition of the relatively rigid support structure for the guide handle and the wheels unavoidably increases the weight of the garment bag to the point where it is burdensome to carry and to use. The relatively rigid support structure and wheels decrease the flexibility of the garment bags to the point where their value as carry-on luggage is greatly diminished, by reason of the fact that it was considerably more difficult to fit the rigid structure and the bag into the overhead compartment or closets.

A further inconvenience which accompanies most rollable garment bags available on the market today is the inability to roll them down the aisles between rows of seats on any commercial aircraft. This fact exists because almost all rollable garment bags on the market today position the clothing in an "upright" orientation when the bag is in a stationary position ready to be rolled. Herein "upright" refers to the vertical axis through the plane of the clothing as it hangs on a traditional hanger. This upright orientation on a hanger of course necessarily means that the shoulder/hanger width direction of the clothing is oriented horizontally. The problem arises because most commercial airlines restrict carry-on baggage to be no larger than 9"×14"×22", and most clothing on hangers require more than 14" to accommodate the shoulder width and hangers of most garments. The 22" dimension therefore must be used to accommodate the shoulders/hangers. Because the other logical possibilities for orientating a 9"×14"×22" size case with respect to the plane of the wheels and guide handle would create an unacceptably awkward rollable piece of luggage, the wheels and guide handle must be configured on the case such that the 22" dimension is oriented either horizontally and parallel to the axis of the wheels or vertically and perpendicular to the axis of the wheels. As stated, most rollable garment bags on market today use the first orientation described, with the clothes upright in the bag and the 22" shoulder direction horizontal and parallel to the axis of the wheels. This does not allow these garment bags to be rolled through a commercial aircraft because 22" is too wide to fit through the aisle between the seat rows of any commercial aircraft. Consequently, they must be carried while inside the aircraft. The other orientation described for orienting the 22" shoulder direction vertically does allow the garment bag to be rolled down any commercial aircraft aisle, however there are several challenges which must be properly addressed in order to have a reliable and user-friendly piece of luggage and to maintain the hanging garments in a wrinkle-free condition, despite the fact that while the bag is closed and stationary or transporting by rolling the garments must be held in an orientation which is rotated 90 degrees with respect to their normal upright orientation on their hangers.

Thus, there is a need for an improved roll-aboard carry-on garment style luggage case, hereinafter referred to as a roller garment bag.

SUMMARY OF THE INVENTION

Described herein is a roller garment bag that combines and integrates a carry-on and a garment bag into a single luggage case, which obtains the desirable conveniences of carry-on luggage while retaining all of the desirable aspects of a garment bag and a carry-on without introducing any significant detriments to the individual advantages of each style of luggage bag by itself.

In one example, a roller garment bag is provided that includes a U-shaped support structure, a flexible panel, a first end panel, a second end panel, a hanger receiver, and a packing pouch. The packing pouch, hereinafter also referred to as an inner compartment, may be a soft-sided compartment or preferably a rigid structure. The U-shaped support structure has a first side panel, a center panel and a second side panel. The first side panel defines a top of the roller bag. The center panel defines a first side of the roller bag and connects the first and second side panels. The second side panel defines a bottom of the roller bag. The flexible panel has a first end and a second end. The first end is coupled to a first edge of the center panel. The flexible panel defines a second side and a third side of the roller bag when the roller bag is in a closed state. The first end panel is coupled to the second end of the flexible panel and the hanger receiver. The second end panel is coupled to a second edge of the center panel. The second edge is disposed opposite the first edge. The first and second end panels reside on a fourth side of the roller bag when the roller bag is in a closed state. The packing pouch is coupled to the second end panel and is movable between a position outward of the support structure when the roller bag is in an open state and a position within the support structure when the roller bag is in the closed state.

In another example, a U-shaped support structure, a flexible panel, a first end panel, a second end panel, a hanger receiver, and a packing pouch. The U-shaped support structure has a first side panel, a center panel and a second side panel. The first side panel defines a top of the roller bag. The center panel defines a first side of the roller bag and connects the first and second side panels. The second side panel defines a bottom of the roller bag. The flexible panel has a first end and a second end. The first end is coupled to a first edge of the center panel. The flexible panel defines a second side and a third side of the roller bag when the roller bag is in a closed state. The first end panel is coupled to the second end of the flexible panel and the hanger receiver. The second end panel is coupled to a second edge of the center panel. The second edge is disposed opposite the first edge. The first and second end panels reside on a fourth side of the roller bag when the roller bag is in a closed state. The packing pouch is coupled to the second end panel and is movable between a position outward of the support structure when the roller bag is in an open state and a position within the support structure when the roller bag is in the closed state. A latch is coupled to the roller garment bag and operable to secure the second end panel to the first end panel. The roller garment bag also includes a telescopic handle and rollers coupled to the support structure. A first zipper is configured to secure a first side edge of the flexible panel to the first side panel while a second zipper is configured to secure a second side edge of the flexible panel to the second side panel. Two edges of the first side panel having one side of the first zipper having a linear portion on the third side of the garment bag and at least one rounded portion on the second side of the garment bag.

In yet another example, a method for closing a roller garment bag is provided. The method includes rotating a packing pouch between side panels of a U-shaped support structure to create a U-shaped hanging garment storage cavity within the roller bag. The packing pouch may or may not have a third end panel coupled by a hinge to a second end panel. The second end panel is coupled between side panels of the U-shaped support structure and also to a center panel of the U-shaped support structure. The whole support structure is then rotated in the direction of the first end panel using the rounded edges of the second side of the U-shaped support structure to facilitate a smooth rolling motion which does not disturb the condition of the garments laid into the hanging compartment of the bag. The method also includes latching the first end panel to either the second end panel or the third end panel, depending upon the particular construction of the packing pouch. The method also includes zipping opposite sides of a flexible panel to the first (top) and second (bottom) side panels of the U-shaped support structure. The flexible panel has a first end coupled to the center panel of the U-shaped structure and a second end coupled to a first end panel.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements of one embodiment may be beneficially incorporated in other embodiments.

DETAILED DESCRIPTION

Figure 1:
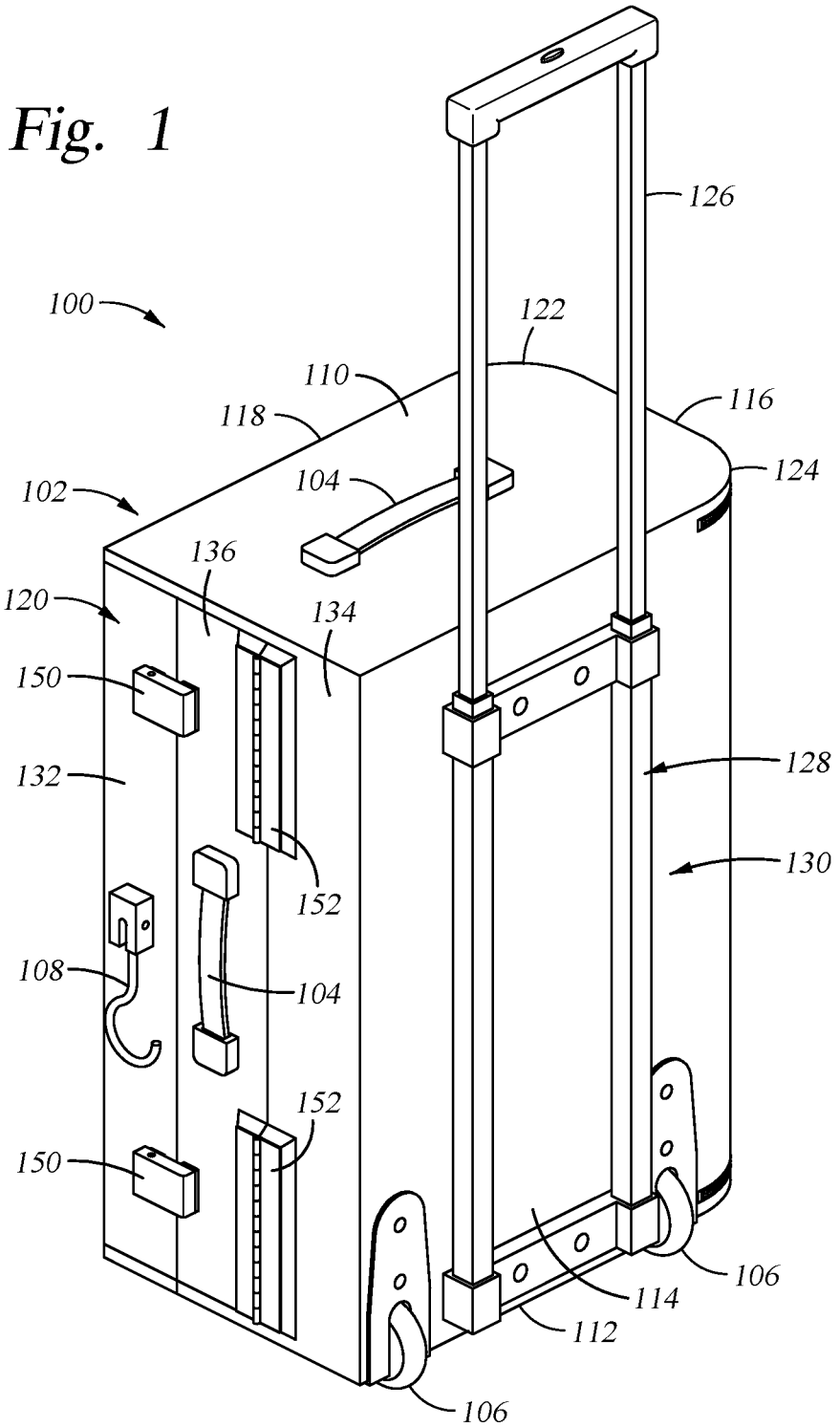
FIG. 1 illustrates a perspective side view of an exemplary roller garment bag.

The present invention combines and integrates a carry-on and a garment bag into a single luggage case, e.g., a roller garment bag, which obtains the desirable conveniences of carry-on luggage while retaining all of the desirable aspects of a garment bag and a carry-on without introducing any significant detriments to the individual advantages of each style of luggage bag by itself. Additionally, the roller garment bag incorporates wheels and a guide handle, so the integrated carry-on and garment bag luggage case can be conveniently rolled on the wheels and maneuvered by the guide handle, including onto and through the aisles of common commercial aircraft. The present invention additionally provides a garment hanger system which combines a premium-quality closet hanger with a hanger system for the garment bag which converts easily for use in either location.

In some examples, the roller garment bag of the present invention may be configured as a luggage case having a configuration of a size and shape compatible with the de-facto airline industry standard of 9"×14"×22" when in a closed condition, and presenting a garment bag configuration for packing clothes when the case is in an open condition.

The roller garment bag includes a rigid support structure and a flexible panel connected to the support structure. The flexible panel extends from the support structure to expose an interior of the panel and of the bag, and the panel forms a curved exterior wall of the roller garment bag when in a closed state. In some examples, the roller garment bag includes at least three selective attachment devices, such as latches, zippers and the like, to connect the flexible panel to the support structure to define a U-shaped garment storage cavity within the roller garment bag when the garment bag is in the closed state.

In accordance with these and other features, another aspect of the present invention relates to a roll-aboard carry-on style luggage case which has a generally rectangular shape when in a closed, ready-to-roll-away condition; formed by a top face, a bottom face, and four side faces, wherein at least one of the side faces has at least one curve in it. The top face opposes the bottom face and both the top and bottom faces extend in the length and width dimension of the roughly rectangular cuboid shape. The first and third sides faces extend in the height and partially the length dimensions of the roughly rectangular cuboid shape. The second and fourth faces extend in the height and width dimensions of the roughly rectangular cuboid shape.

The flexible panel of the roller garment bag is fixedly attached to the one of the side faces and wraps around the rigid support structure to enclose a U-shaped garment storage cavity, which is designed to hold the hangable garments inside the roller garment bag by hangers when the bag is in either an open or closed condition. The flexible panel is also strong enough to support the weight of the roller garment bag and contents when the bag is hanging in a closet or on a door.

In one example, the flexible panel terminates at an end panel that also forms a portion of the one of the side faces of the bag. The end panel, when forming the side face of the roller garment bag, attaches to another end panel by a latch or other fastening device. The interior of the roller garment bag is generally rectangular-shaped and adapted for receiving garments when the flexible panel is opened.

The support structure includes side and center panels that form the top face, one of the side faces, and the bottom face of the roller garment bag. An end panel, that together with the end panel attached to the flexible exterior panel, forms at least a portion of another one of the side faces, is rigidly secured to the side and center panels, thus holding the three panels in a reinforced U-shape. Corners of the side panels are curved so as to allow the roller garment bag to be easily opened and closed by having or placing the bag on a floor, bed or other horizontal surface, and rolling the support structure along in the direction of the flexible panel. Once the support structure has been rotated about 180 degrees, the end panels may be latched. The flexible panel then attaches to the edges of side faces of the support structure by suitable devices, such as zippers, to complete the closing of the roller garment bag.

Thus, the roller garment bag has a generally rectangular cuboid configuration of a size and shape similar to conventional carry-on luggage when in a closed state and presenting a garment bag configuration for packing clothes in a garment bag-style when the roller garment bag is in an open state.

In addition, the roller garment bag includes an inner compartment (e.g., packing pouch) to provide useable packable space within the case for clothing and other items which are not amenable to being hung as in a garment bag. The inner compartment is coupled by one or more hinges to the second end panel secured to the support structure, and when the roller garment bag is closed, one panel of the inner compartment may, with the other end panels, form a portion of one of the side faces of the roller garment bag. The inner compartment is shaped with smoothly curved corners along the side of the compartment facing away from the hinge. These smoothly-curved corners ensure that when the roller garment bag is closed, the hangable garments which wrap around the inner compartment do not become creased or wrinkled. When folded inside the roller garment bag, the inner compartment may be independently attached to the inside of the rigid side panels of the U-shaped support structure, so that the weight of the inner compartment is not borne by the hanging garments. The inner compartment is hinged so that may be rotated away from the roller garment bag to facilitate loading and unloading of items from an interior of the compartment, and so as not to interfere with loading and unloading of hangable garments. Furthermore, the inner compartment is in a low position for easy loading through its top opening when the roller garment bag is hanging, for example, in a closet or from a door.

Although the roller garment bag may be utilized with conventional garment hangers, there are benefits to employing special hangers and hanger attachment mechanisms inside a roller garment bag. One benefit is that a special hanger attachment may be made much more efficient in terms of space utilization inside the bag because, by necessity, a conventional hanger hook extends typically several inches above the collar of a garment so as to be compatible with being hung on a conventional large-diameter closet rod. The savings in space provided by the shorter hanger attachment mechanism can be utilized by longer hanging garments. Another benefit is that a conventional hook does not restrict rotational movement of the hanger and garments in the plane of the hanger, and therefore garments would be not be restricted by the hanger from rotating into and being crushed against the inside of the bag if and when the bag is rotated in the plane of the hangers, for example during travel. A special hanger and attachment means may provide the ability to restrict rotation in the plane of the hanger, thus avoiding crushing and wrinkling the garments against the inside of the bag. For those reasons, hangers are also described herein that have a convertible design. The hangers may be converted very easily from having a conventional hanger hook presented at the top for use in hanging garments on a conventional hanger rod to having an attachment presented at the top which is specifically designed to mate with a special receiver affixed inside the first end panel. The benefit of the convertible hanger is that garments may be kept on these hangers and stored on a conventional closet rod during times of travel or otherwise, and then taken from the closet rod and conveniently placed directly into the garment bag without need of swapping to special hangers, and then most likely wanting to reverse that operation at the travel destination.

In accordance with these and other features, a further aspect of the present invention relates to a method of using a luggage case having a roughly rectangular cuboid configuration of a size and shape similar to a carry-on when in a closed condition and presenting a garment bag configuration for packing articles in a garment bag style when the case is in an open condition.

The roller garment bag is also configured to be easily closed from an open state by rolling the bag over the horizontally-arranged hanging garments. An example of a method for closing the roller garment bag includes, beginning with the case laid open on a horizontal surface, the inner compartment is rotated to a position between the side panels of the U-shaped support structure. Then, starting from the back edge of the support structure which shares the hinge with the inner compartment, the support structure is rolled in the direction of the curved corners on the opposite side of the hinge, toward the extended flexible panel. The support structure is continued to be rolled in the direction of the extended flexible panel until the end panels are aligned. Stated differently, the support structure is rolled 180 degrees until the end panels are aligned and can be secured together, thus locking the bag in a closed state without having to disturb the arranged state of the hanging garments or requiring any separate features of the bag to restrain the movement of the garments during the closing operation; features which might cause wrinkling of the garments at the point(s) of contact. As or after the roller garment bag is rolled into the closed state, the zippers can be utilized to secure the flexible panel to the support structure. To open the roller garment bag, the zippers are undone, the end panels are released from their secured states and then the support structure may be rotated in the reverse direction. Once the flexible panel is extended, the inner compartment may be rotated out from between the side panels of the support structure to allow access to both the garments and the interior of the inner compartment.

Figure 2:
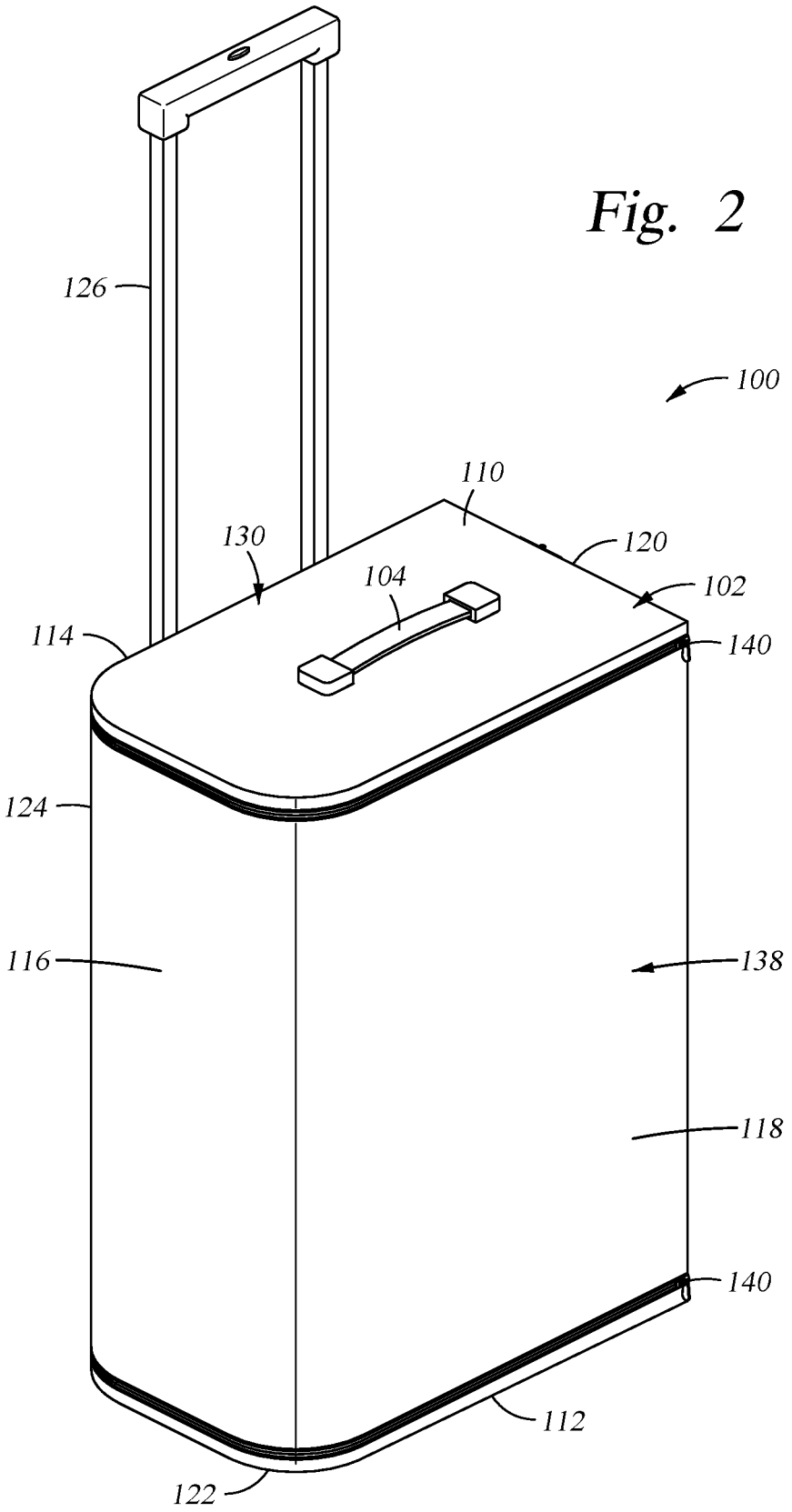
FIG. 2 illustrates another perspective side view of the roller garment bag of FIG. 1.

Turning now to the perspective front and back side views of an exemplary roller garment bag 100 depicted in FIGS. 1 and 2, the roller garment bag 100 includes a case 102 having a stowable handle 126 and wheels 106. As discussed above, the case 102 has a generally rectangular cuboid shape formed by a top face 110, a bottom face 112, and side faces 114, 116, 118, 120. The faces 110, 112, 114, 116, 118, 120 form the exterior of the case 102.

The stowable handle 126 is coupled to or adjacent to the side face 114, of the case 102. In one example, the stowable handle 126 is telescopic. The lower fixed portion 128 of the stowable handle 126 may be located external to the case 102, as shown in FIG. 1, or may be internal to the case 102. In another example, the stowable handle 126 may be a double-shaft design as shown in FIG. 1 or may be of a single-shaft design. The wheels 106 are coupled to one or both of the bottom face 112 and one of the side faces 114, 120. The wheels 106 may swivel on a vertical axis or have a fixed axel. The case 102 includes at least two wheels 106, but three or four or more wheels 106 may also be utilized. Two of the wheels 106 are generally located on the same side of the case 102, and extends at least partially beyond the bottom face 112 and may also extend beyond one of the side faces 114, 116, 118, 120 to allow the case 102 to be tilted and rolled behind a traveler in the conventional fashion.

In one example, the stowable handle 126 is closer to one side of the case 102 as shown in FIG. 1. Having the stowable handle 126 offset relative to the midpoint between two opposite sides of the case 102 allows the case 102 to be preferentially positioned more directly behind a traveler when being rolled, thus allowing the roller garment bag 100 to be moved through tight spaces without hitting adjacent objects, such as airplane seats or other obstacles. The offset should be at least 1 inch and preferably between 3 inches and 5 inches.

The case 102 may optionally include one or more carry handles 104. In the example depicted in FIGS. 1 and 2, one handle 104 is located on the top face 110 while a second handle 104 is located on one of the side faces 114, 116, 118, 120.

The side face 116 is curved to facilitate the case 102 being rolled during closing and opening. The side face 116 may be a full half round in profile or may comprise two or more smaller curves which complete a 180-degree turn in aggregate.

The faces 110, 112, 114, 116, 118, 120 of the case 102 are formed from a rigid U-shaped support structure 130, a flexible panel 138 and at least one or more end panels. In FIG. 1, three end panels 132, 134, 136 are shown. The flexible panel 138 is coupled at opposite ends to the first end panel 132 and the support structure 130. When the case 102 is in a closed state, opposite sides of the flexible panel 138 are coupled to the support structure 130 by a pair of zippers 140.

The second end panel 134 is coupled to and part of the support structure 130. In the example of FIG. 1, the second end panel 134 is also coupled by at least one hinge 152 to the third end panel 136. Although two hinges 152 are shown in the example of FIG. 1, a single piano hinge, a living hinge or other types of hinge or hinges may be utilized.

Also in the example of FIG. 1, a latch 150 or other type of securing mechanism is utilized to secure the third end panel 136 to the first end panel 132 when the case 102 is in a closed state. In one example, the latch 150 may be an over-center latch, with cam and catch portions coupled to the first and third end panels 132, 136. When the latch 150 is released, the flexible panel 138 is unzipped from the support structure 130 and the case 102 is laid flat on its side 114, the case 102 may be unrolled to an open state, as depicted in FIGS. 3 and 4.

Figure 3:
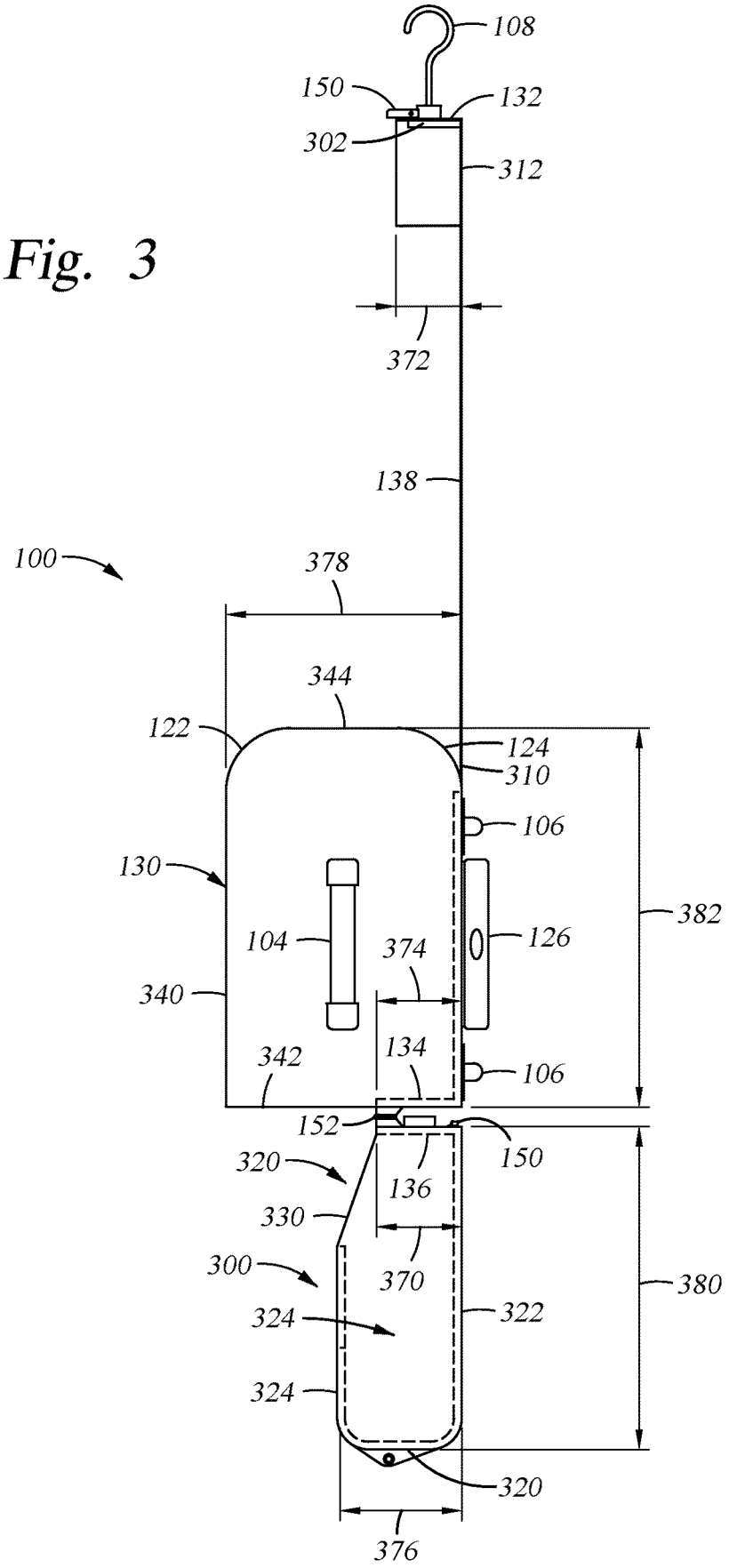
FIG. 3 is a schematic side view of the roller garment bag of FIG. 1 in an open state.
Figure 4:
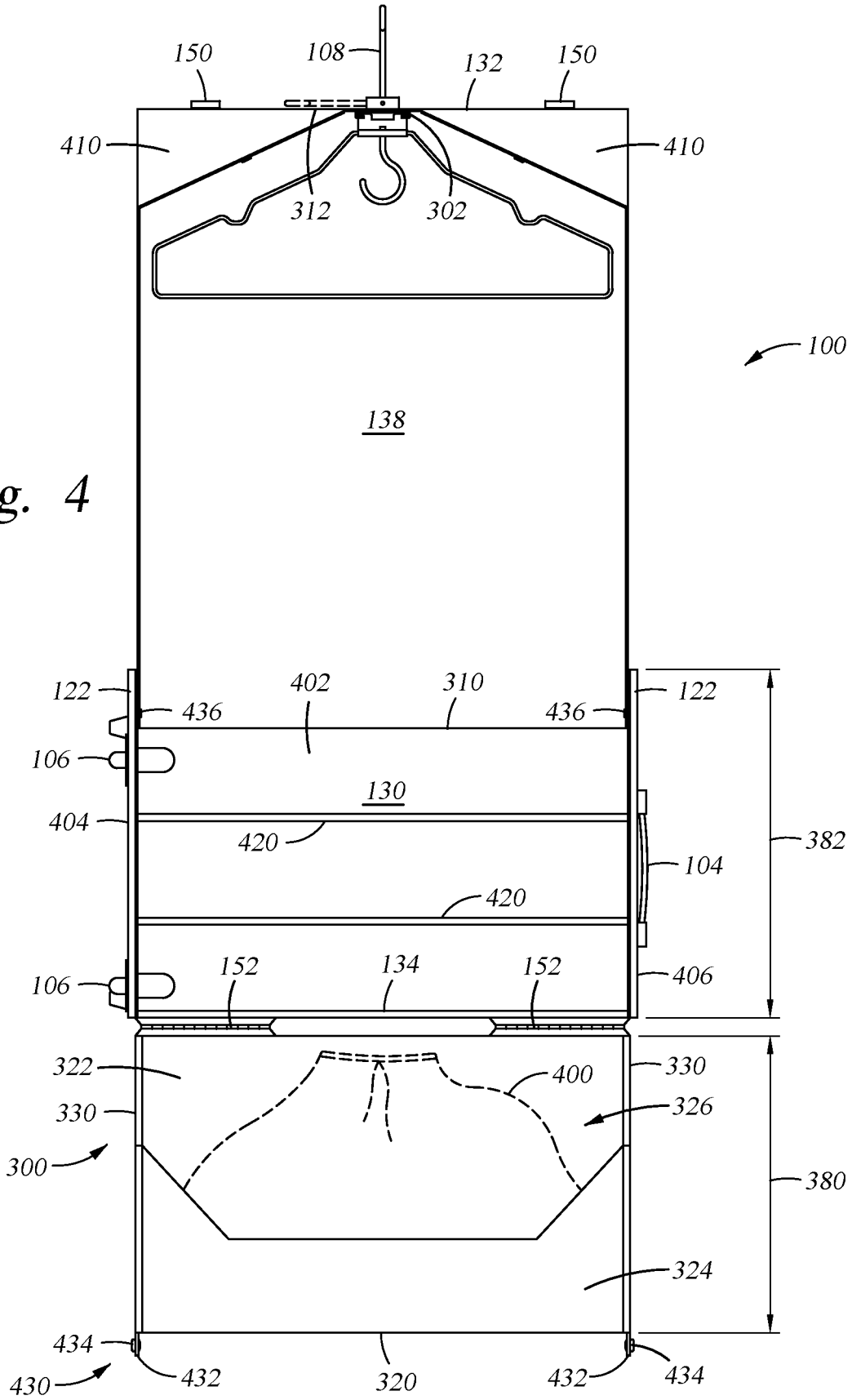
FIG. 4 is a schematic top or front view of the roller garment bag of FIG. 1 in an open state.

FIGS. 3 and 4 are schematic side and top views of the roller garment bag 100 in an open state. As discussed above and better illustrated in FIGS. 3 and 4, the U-shaped support structure 130 of the case 102 is formed from two parallel and spaced apart side panels 404, 406 that are coupled by a center panel 402. The panels 402, 404, 406 also form the faces 110, 112 and 114 of the case 102. The panels 402, 404, 406 are formed from a rigid material, such as plastic, plastic or fabric coated wood product (i.e., plywood, particleboard, melamine and the like), or other structurally and aesthetically suitable material. The panels 404, 406 include edges 340, 342, 344. The edges 340 of the panels 404, 406 bound the open side of the U-shape of the support structure 130. The edges 344 of the panels 404, 406 extend between the edge 340 and the center panel 402. The edges 344 also have the rounded corners 122, 124, which when the bag is closed, create the curved shape of side face 116 of case 102. The edges 342 are opposite the edges 344, and are connected to the edges 344 by edges 340.

In one example, at least the edges 342 of each of the side panels 404, 406 are coupled to the second end panel 134 to increase the rigidity of the U-shaped support structure 130.

In another example, the center and side panels 402, 404, 406 are coupled to the second end panel 134, making the U-shaped support structure 130 very rigid and structurally sound.

The U-shaped support structure 130 may include one or more garment retaining strips 420 for holding garments to the center panel 402 of the support structure 130. The strips 420 hold the tails/bottoms of the hanging garments within the case 102 with a firm but gentle distributed force to prevent rotation and slumping/wadding/wrinkling of the hanging garments when the bag 100 is turned 90 degrees from the usual hanging orientation to the "ready-to-roll" orientation. The strips 420 may be removable, elastic, retractable, or have another configuration.

In one example, the strips 420 are ferromagnetic material strips configured to be retained by magnets embedded in the center panel 402. Alternatively, the strips 420 may be of a magnetic material configured to be attracted to ferromagnetic material embedded in the center panel 402. In another example, the strips 420 are constant-force springs configured to apply a distributed clamping force to the garments in the direction perpendicular to the length of the unrolled spring. In an alternative construction, magnetic material may be both the material of the constant-force spring and/or the material embedded in the center panel 402. The important distinction in these magnetic and constant-force spring configurations over elastic strips or simple flaps of fabric to constrain the movement of the garments within the bag is to distribute the force holding the tails of the garments over the length of the items exerting the holding force, as opposed to providing constraining forces which are concentrated or exclusively applied at the ends of the strips. Furthermore, the garments may be carefully arranged to be flat against the panel 402 before the clamping force is applied and then that is how they will be held until released. Constraining movement of the garment within the bag with a distributed clamping force provides a way to prevent the garments from shifting significantly during travel, thereby minimizing wrinkling and locating the strips specifically along the garment tails minimizes the harm from the wrinkling that may be incurred from the strips.

A first end 310 of the flexible panel 138 is coupled to the U-shaped support structure 130 on the opposite side of the support structure 130 from the second end panel 134. The flexible panel 138 extends from the support structure 130 to a second end 312 that is coupled to the first end panel 132. The flexible panel 138 is made from a flexible material, such as a plastic sheet or fabric webbing and may or may not comprise rigid transverse structural elements as well. Edges of the flexible panel 138 extending between the ends 310, 312 include one half of the zippers 140 with the other half of the zippers 140 being disposed on edges 340, 344 of the support structure 130.

The end panels 132, 134, 136 are generally fabricated from a rigid material, such as metal, plastic or wood product. The exterior of the first end panel 132 also provides a mounting surface for the hook 108. The interior of the first end panel 132 also provides a mounting surface for a hanger receiver 302. The hanger receiver 302, described below with reference to FIGS. 7 and 8, allows garment hangers to be secured and organized within the case 102. Optionally, compartments 410 may be located adjacent and to either side of the hanger receiver 302 next to the interior of the first end panel 132. The first end panel 132 may also form a portion of the walls of the compartments 410.

Opposite the flexible panel 138, an inner compartment, also referred to as a packing pouch 300, is coupled to the second end panel 134 by the one or more hinges 152. The packing pouch 300 includes a pouch end panel 320 coupled to the second end panel 134 by a pouch bottom 322 to bound an interior pouch cavity 328. Sides of the interior pouch cavity 328 are bounded by pouch sidewalls 330. The pouch sidewalls 330 are also coupled to the panels 134, 320 and the pouch bottom 322. In one example, a lip 324 is coupled to the pouch end panel 320 and a portion of the sidewalls 330. The lip 324 extends toward, but not completely to, the third end panel 134, forming an opening 326 through which the interior pouch cavity 328 may be accessed. The location of opening 326 and lip 324 facilitates retention of objects within the interior pouch cavity 328 while the roller garment bag 100 is hanging in an open state. Optionally, netting or a drawstring bag 400 may be placed or secured in the interior pouch cavity 328.

In one example, the first and second end panels 132, 134 have heights 372, 374 that are in aggregate substantially equal to a height 378 of the sides of the U-shaped support structure 130. In such an embodiment, the first and second end panels 132, 134 form the side face 120 of the case 102. This example is illustrated in FIGS. 7A-7D, as later described below. In the example depicted in FIG. 3, the first, second and third end panels 132, 134, 136 have heights 372, 374, 370 that are in aggregate substantially equal to the height 378 of the sides of the U-shaped support structure 130. Optionally, the height 376 of the end panel 320 may be shorter than the height 370 of the third end panel 136 and so provide additional room within the case 102 when the packing pouch 300 is rotated between the sides of the U-shaped support structure 130. To provide clearance for garments to wrap around the packing pouch 300, a length 380 of the packing pouch 300 is shorter than a length 382 of the U-shaped support structure 130.

The packing pouch 300 may optionally be locked in position when rotated between the side panels 404, 406 of the support structure 130 to prevent the weight of the packing pouch 300 from pressing against the garments disposed in the case 102. In one example, the packing pouch 300 and one or both of the side panels 404, 406 include a lock 430. The lock 430 may be a latch, snap, hook and loop, detent pin, plunger pin, or fast pin that selectively engages with the support structure 130 to secure the packing pouch 300 in a position substantially parallel with the center panel 404 of the support structure 130. In other embodiments, one or both of the side panels 404, 406 include a ledge or other stop that rigidly supports the packing pouch 300 within the support structure 130 in an orientation substantially parallel with the center panel 402. In the example depicted in FIG. 4, the lock 430 is configured as a snap mounted to taps 432 extending from the end panel 320. The snap includes a socket 434 affixed to the tab 432 that can be selectively engaged with a stud 436 affixed to the side panels 404, 406 of the support structure 130. As the packing pouch 300 is disposed at the opposite end of the case 102 relative to the hanger receiver 302, the packing pouch 300, when folded into the case 102, remains well clear of the hanger receiver 302 so that collars of garments disposed on hangers within the case 102 are well spaced from the packing pouch 300 and thus are not subject to wrinkling, crushing or other damage.

Figure 5:
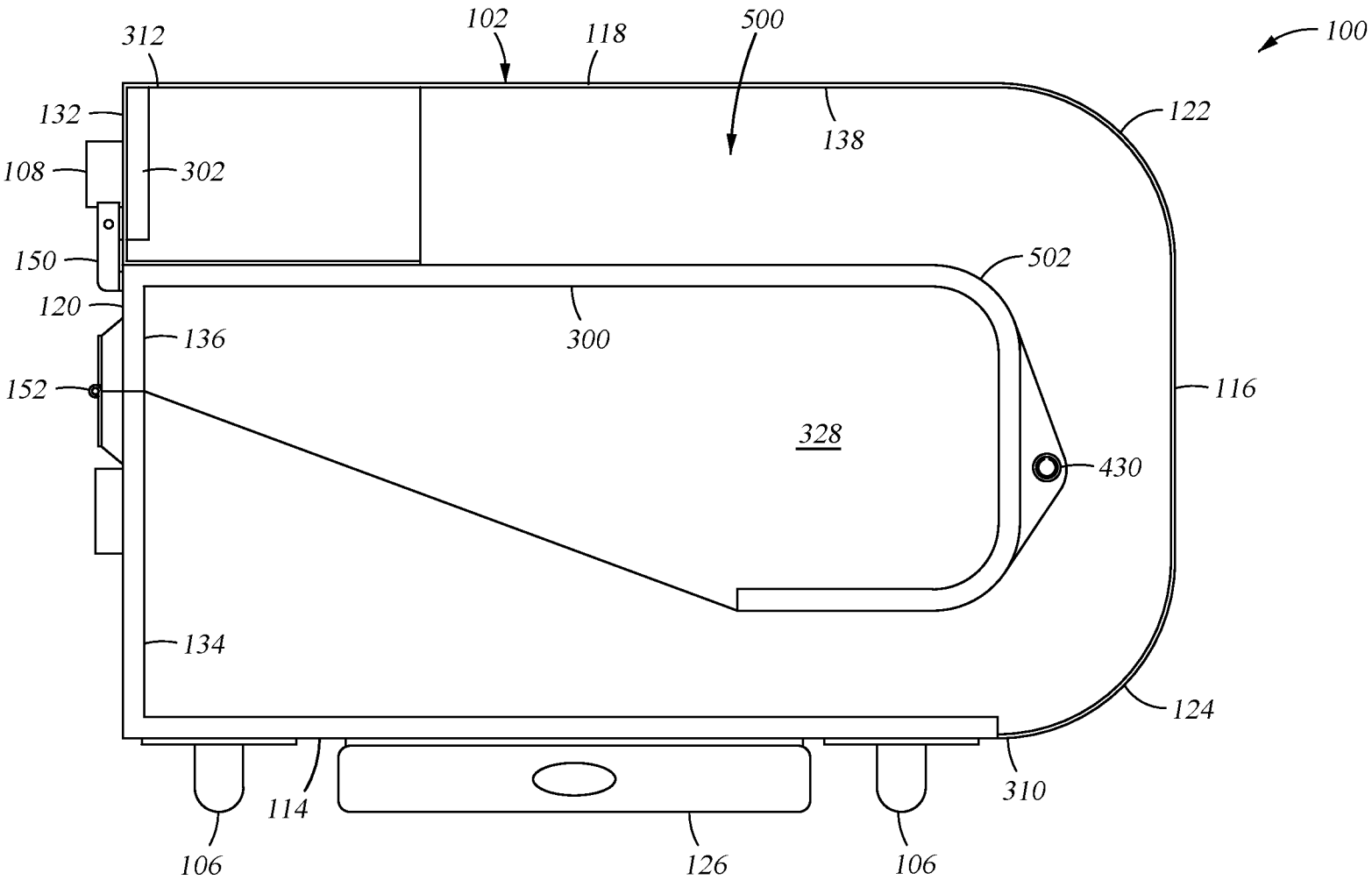
FIG. 5 is a schematic side view of the roller garment bag of FIG. 1 in a closed state. Some internal elements are artificially made visible.

FIG. 5 is a schematic side view of the roller garment bag 100 in a closed state, the packing pouch 300 having been rotated between the side panels 404, 406 of the support structure 130. The packing pouch 300, center panel 402 and flexible panel 138 form a U-shaped garment storage cavity 500. Exterior edges 502 of the pouch end panel 320 may be rounded so that garments present in the garment storage cavity 500 of the case 102 are not wrinkled as the garments bend around the packing pouch 300 at the bottom of the U-shape of the garment storage cavity 500.

In the closed state of the case 102 illustrated in FIG. 5, the latches 150 secure the end panels 132, 136, and zippers 140 secure the support structure 130 to the flexible panel 138. Additionally, the hook 108 may be moved to a stowed position, one example of which is later discussed with reference to FIG. 8.

Figure 6A:
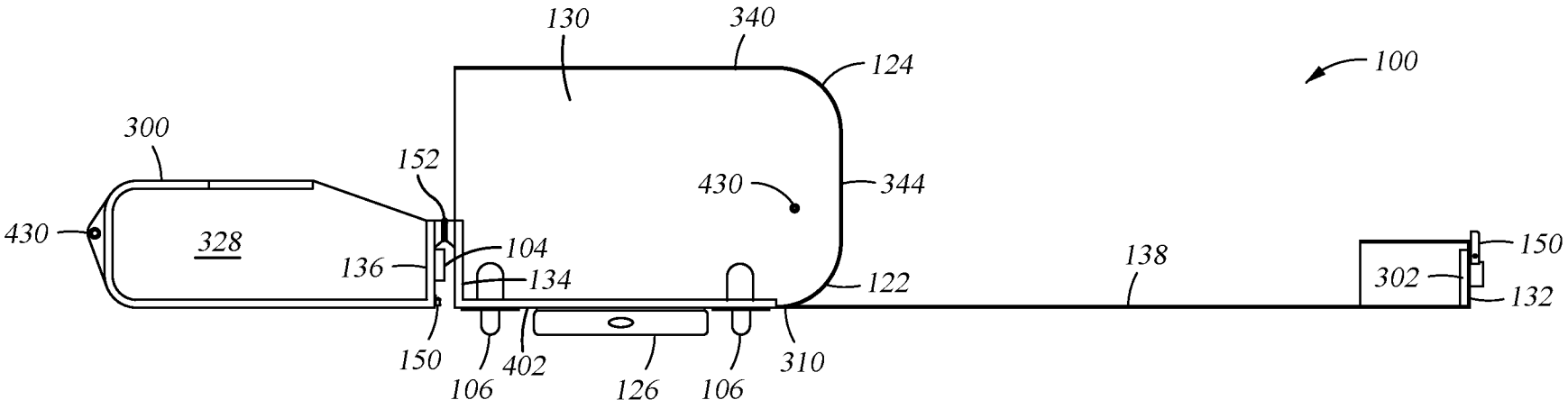
FIGS. 6A-6D are schematic side views of the roller garment bag during closing from the open state to the closed state. Some internal elements are artificially made visible.
Figure 6B:
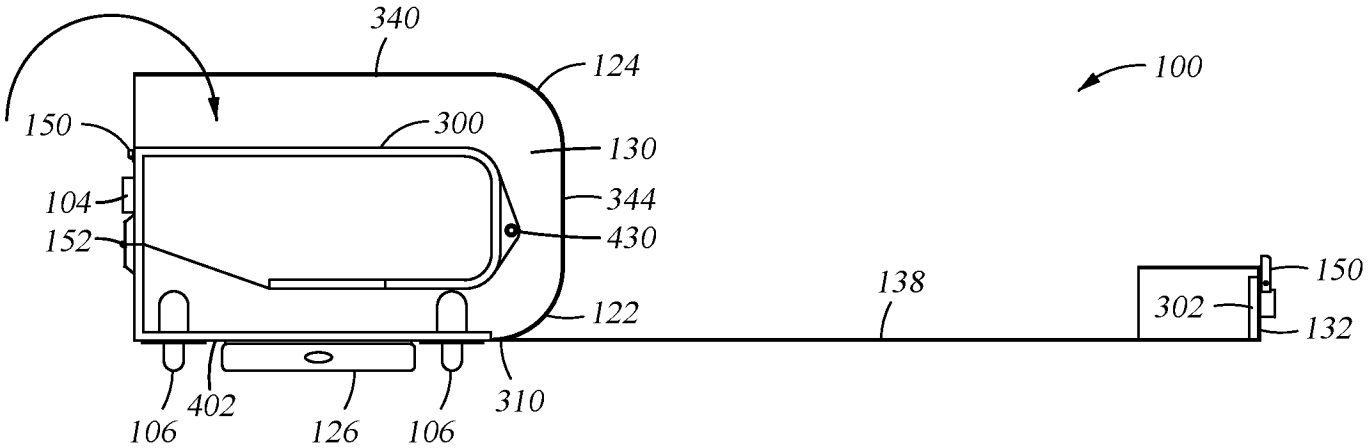
Figure 6D:
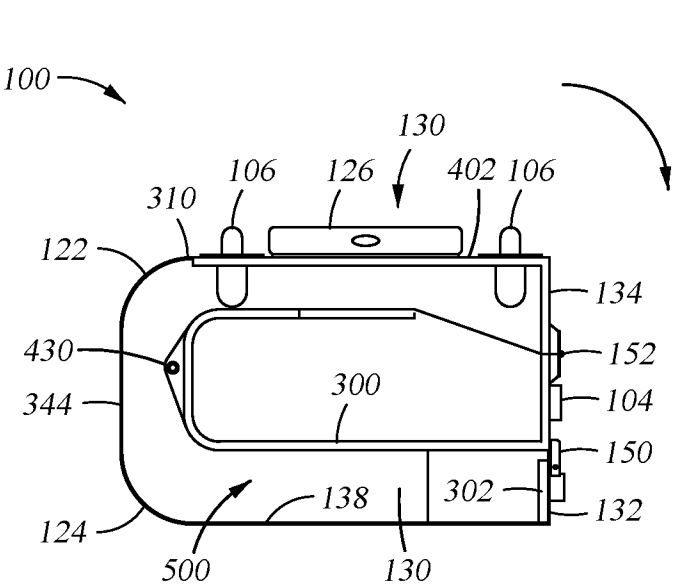
Figure 6C:
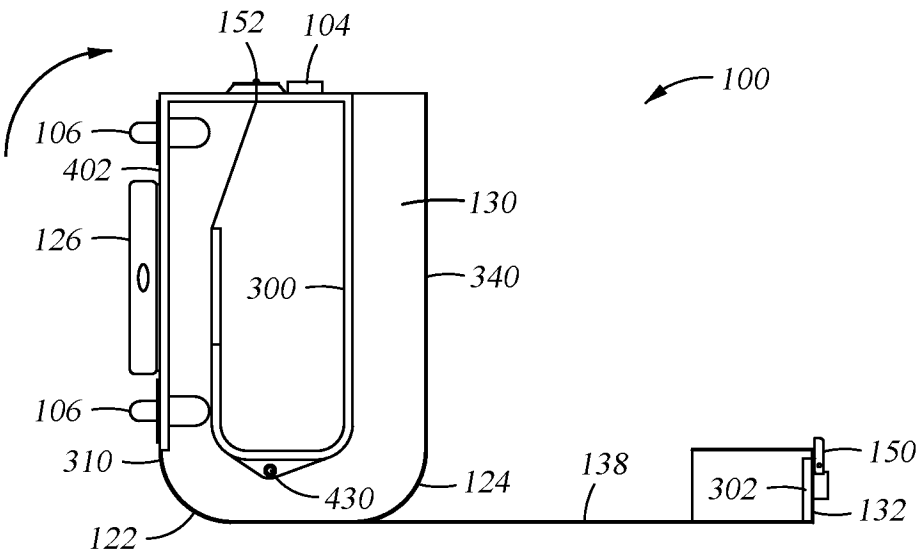
Figure 6E:
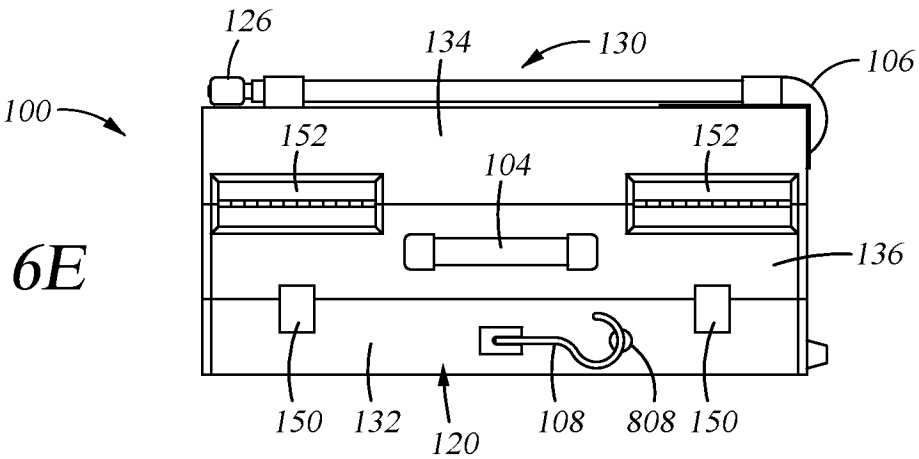
FIG. 6E is a side view of the roller garment bag in the closed state.

FIGS. 6A-6D are a sequence of schematic side views of the roller garment bag 100 illustrating closing the case 102 from the open state to the closed state. With reference first to FIG. 6A, the roller garment bag 100 is shown in a fully open state. The case 102 is shown laid open on a horizontal surface with the packing pouch 300 extending outward of the support structure 130. The packing pouch 300 is then rotated about 180 degrees into a position between the side panels of the support structure 130, as shown in FIG. 6B. The packing pouch 300 is optionally locked into position within the support structure 130 utilizing the lock 430. Then, starting from the second end panel 134 of the support structure 130 which shares the hinge 152 with the packing pouch 300, the support structure 130 is rolled in the direction of the curved corners 122, 124 on the opposite side of the hinge 152, toward the extended flexible panel 138, as shown in FIG. 6C. The support structure 130 is continued to be rolled in the direction of the extended flexible panel 138 until the end panels 132, 134, 136 are aligned, as shown in FIG. 6D. Stated differently, the support structure 130 is rolled 180 degrees until the end panels 132, 136 are aligned and can be secured together using the latch 150, thus locking the bag 100 in a closed state, as also shown in the side view of the roller garment bag 100 illustrated in FIG. 6E. As or after the roller garment bag 100 is rolled into the closed state, the zippers 140 can be utilized to secure the flexible panel 138 to the support structure 130. To open the roller garment bag 100, the zippers 140 are undone and the end panels 132, 136 are released from their secured state so that the support structure 130 may be rotated in the reverse direction. Once the support structure 130 has been rotated about 180 degrees, the packing pouch 300 may be rotated out from between the side panels of the support structure 130 to allow access to both the hanging garments and the interior pouch cavity 328 of the packing pouch 300.

FIGS. 7A-7D are a sequence of schematic side views of an alternative embodiment of a roller garment bag 700 illustrating closing the case 102 from the open state to the closed state. In the example depicted in FIGS. 7A-7D, the first and second end panels 132, 134 form the side face 120 of the case 102, with the packing pouch 300 residing completely within the case 102 when closed. The third end panel 136 is optional and not shown in this example, and the hinge 152 couples the pouch bottom 322 of the packing pouch 300 directly to the second end panel 134. When the packing pouch 300 includes the third end panel 136, the hinge 152 couples to one or both of the third end panel 136 and the pouch bottom 322 of the packing pouch 300, but the third end panel 136 is rotated completely within the interior of the case 102 when the case 102 is in a closed state. Additionally in this example, the latch 150 directly secures the first and second end panels 132, 134, for example with the cam of the latch 150 residing on one of the panels 132, 134 and the catch of the latch 150 residing on the other of the panels 132, 134. In other aspects, the roller garment bag 700 is essentially identical to the roller garment bag 100.

Figure 7A:
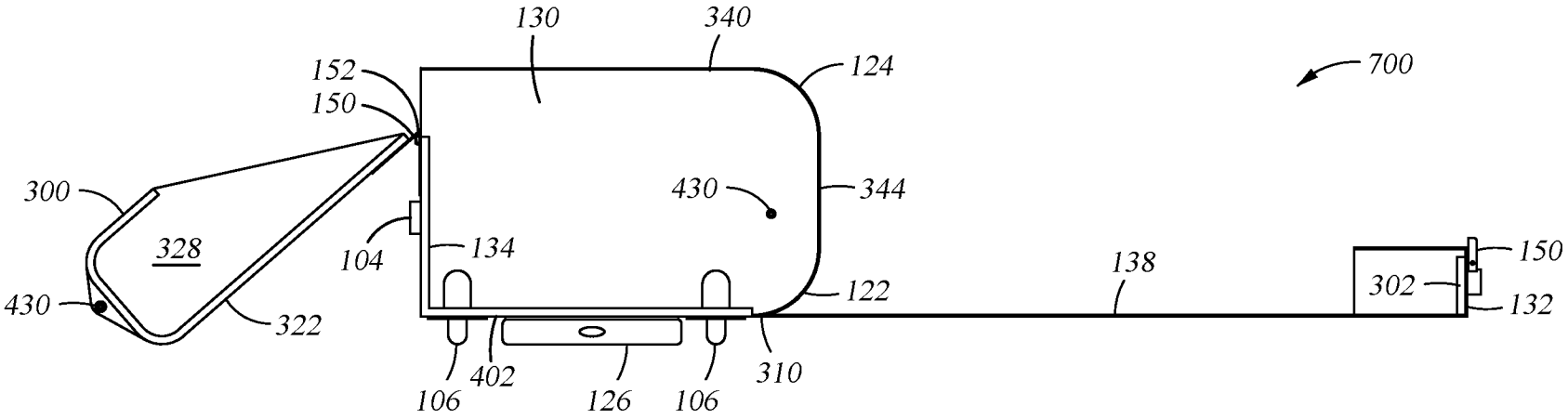
FIGS. 7A-7D are schematic side views of another embodiment of the roller garment bag during closing from the open state to the closed state. Some internal elements are artificially made visible.
Figure 7B:
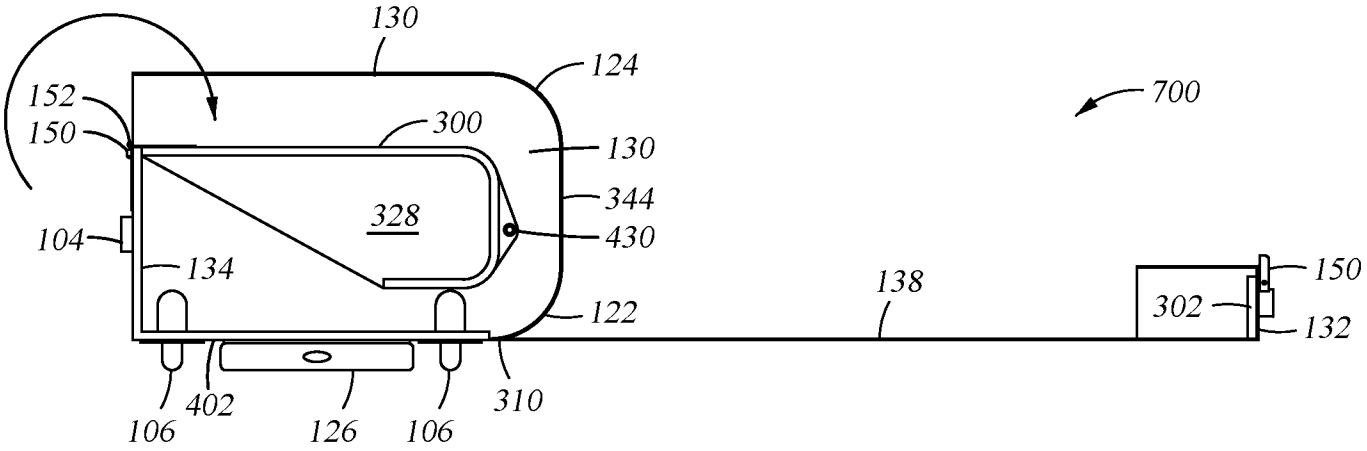
Figure 7D:
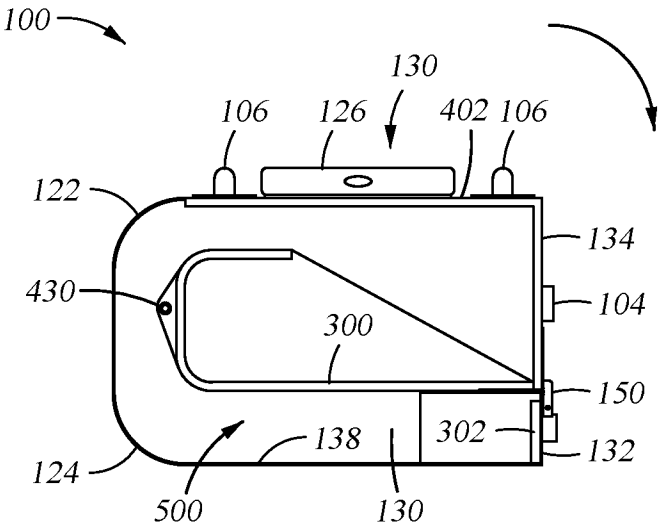
Figure 7C:
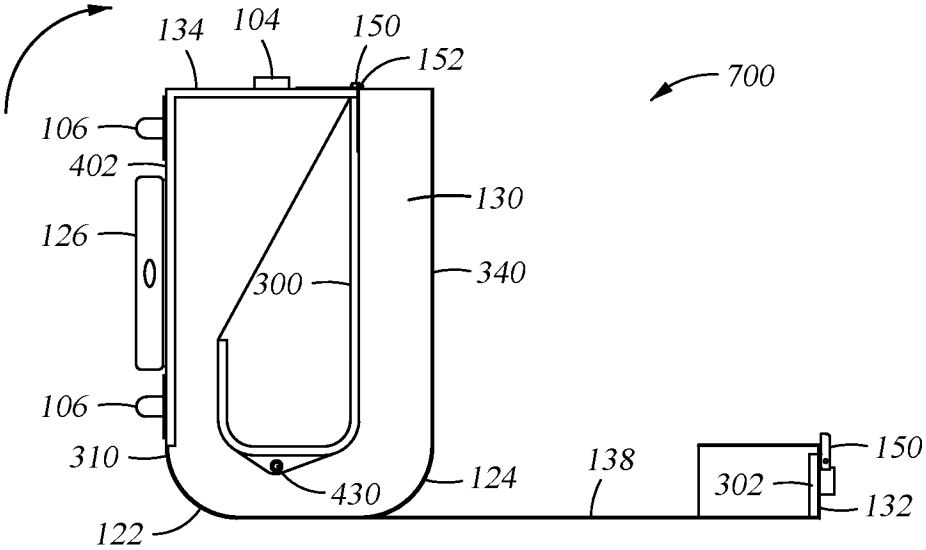
Figure 7E:
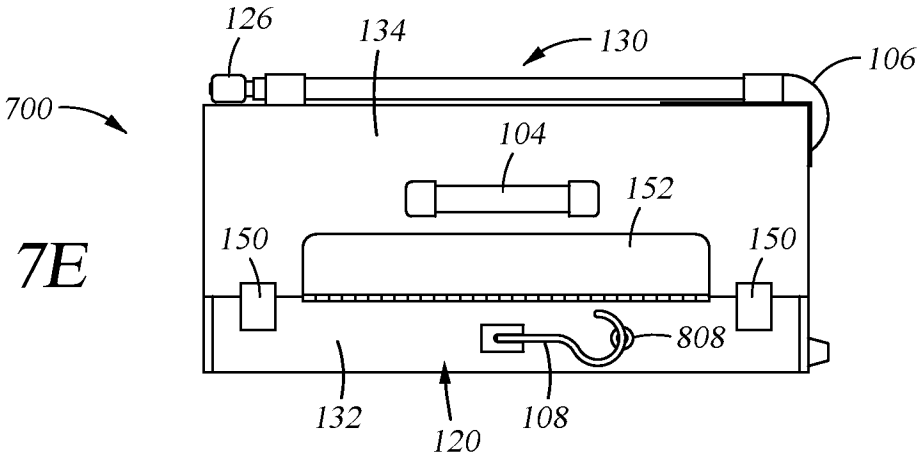
FIG. 7E is a side view of the roller garment bag in the closed state.

With reference first to FIG. 7A, the roller garment bag 100 is shown in a fully open state. The case 102 is shown laid open on a horizontal surface with the packing pouch 300 extending outward of the support structure 130. The packing pouch 300 is then rotated about 180 degrees into a position completely between the side panels of the support structure 130, as shown in FIG. 7B. The packing pouch 300 is optionally locked into position within the support structure 130 utilizing the lock 430. Then, starting from the second end panel 134 of the support structure 130 which shares the hinge 152 with the packing pouch 300, the support structure 130 is rolled in the direction of the curved corners 122, 124 on the opposite side of the hinge 152, toward the extended flexible panel 138, as shown in FIG. 7C. The support structure 130 is continued to be rolled in the direction of the extended flexible panel 138 until the end panels 132, 134 are aligned, as shown in FIG. 7D. Stated differently, the support structure 130 is rolled 180 degrees until the end panels 132, 134 are aligned and abutting, with the packing pouch 300 clear from between end panels 132, 134, so the end panels 132, 134 can be secured directly together using the latch 150, thus locking the bag 700 in a closed state, as also shown in the side view of the roller garment bag 100 illustrated in FIG. 7E. As or after the roller garment bag 100 is rolled into the closed state, the zippers 140 can be utilized to secure the flexible panel 138 to the support structure 130. To open the roller garment bag 700, the zippers 140 are undone and the end panels 132, 134 are released from their secured state so that the support structure 130 may be rotated in the reverse direction. Once the support structure 130 has been rotated about 180 degrees, the packing pouch 300 may be rotated out from between the side panels of the support structure 130 to allow access to both the hanging garments and the interior pouch cavity 328 of the packing pouch 300.

Figure 8:
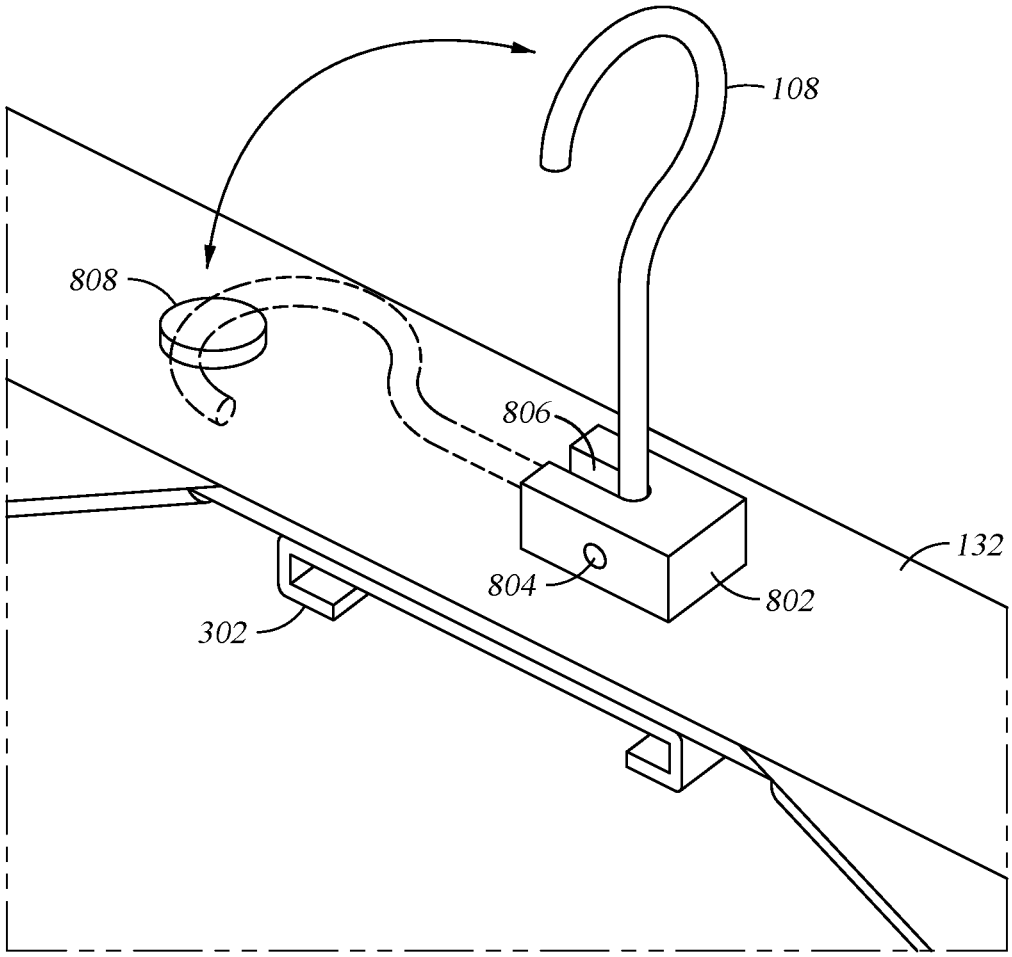
FIG. 8 is a perspective side view of one example of a hook that can be utilized to hang the roller garment bag, for example, while in the open state.

FIG. 8 is a perspective side view of one example of a hook 108 that can be utilized to hang the roller garment bag 100, for example, while in the open state. The hook 108 is coupled to the first end panel 132 by a mounting block 802 by fasteners or other suitable technique. The mounting block 802 includes a slot 806 that is open through at least two sides of the block 802. One end of the hook 108 is retained in slot 806 by a pin 804. The slot 806 has a width sufficient to allow the hook 108 to rotate about 90 degrees within the slot 806 about the pin 804. As illustrated in FIG. 8, the hook 108 can rotate between a ready to use upright position, and a stowed position as shown in phantom. It is contemplated that the hook 108 may be moved between ready to use and stowed positions utilizing different apparatus, techniques or methodologies. In another example, the hook 108 may be made from a magnetically permeable material such as steel or plated steel and a magnet 808 placed appropriately inside either a compartment 410 or at an appropriate position within the wall of the first end panel 132 to hold the hook 108 securely in its stowed position.

Figure 9A:
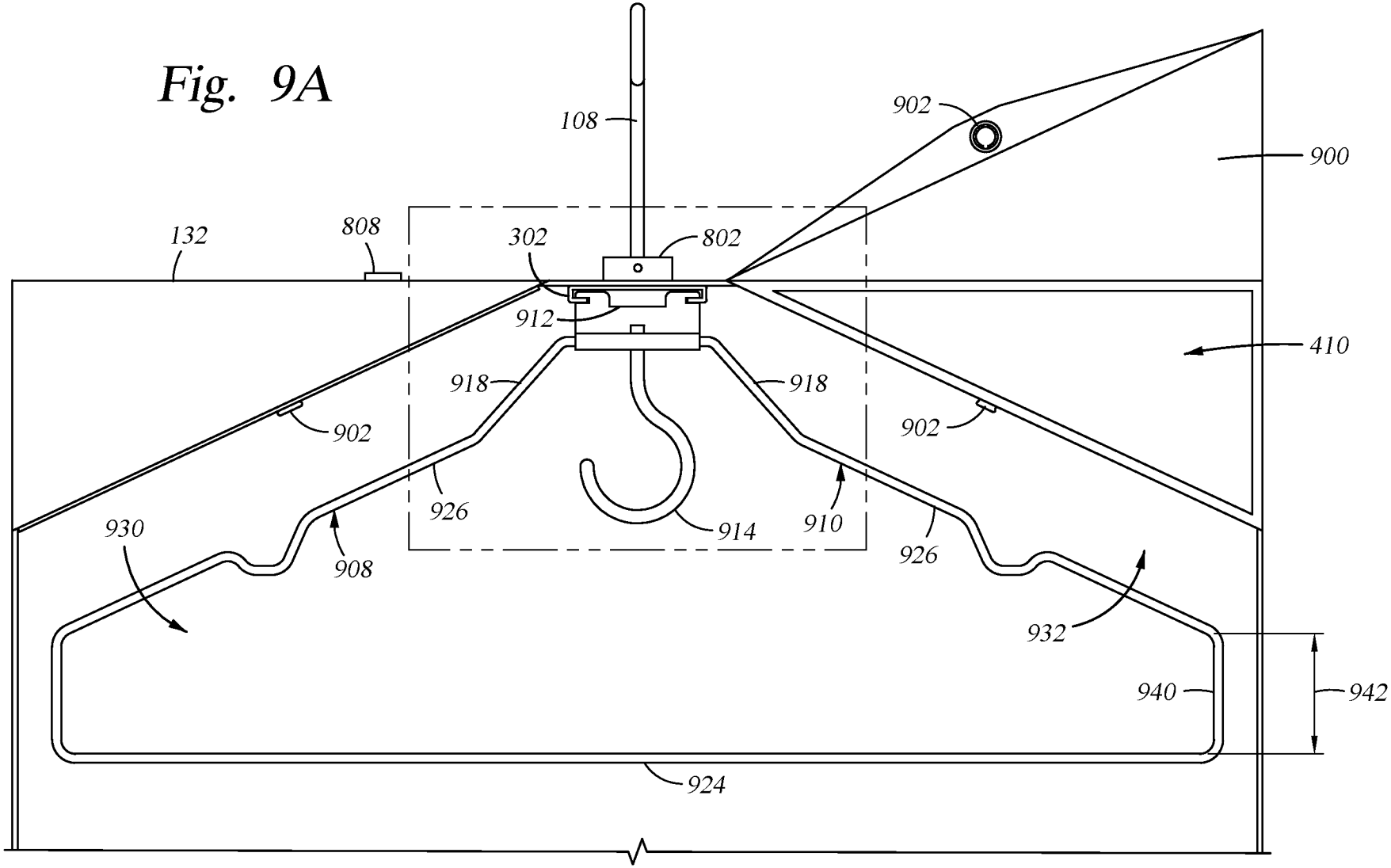
FIG. 9A-9C are partial front and side views of an interior of one end of the roller garment bag while in the open state illustrating a hanger receiver engaged with a mating element of a hanger, the mating element of the hanger shown exposed to an exterior of the hanger with a hook of the hanger shown stowed within an interior of the hanger.

FIG. 9A is a partial front view of an interior of one end of the roller garment bag 100 while in the open state illustrating the hanger receiver 302 engaged with a hanger 910. In the example of FIG. 9A, the compartments 410 are shown with greater detail, located adjacent and to either side of the hanger receiver 302 next to the interior of the first end panel 132. The first end panel 132 may form a portion of the walls of the compartment 410. The compartment 410 may be closed by a cover 900. The cover 900 may be coupled to the first end panel 132, and include a closure 902. The closure 902 may be in the form of a magnet, snap, hook and loop, latch or other device that secures the cover 900 over the compartment 410 in a manner that retains contents within the compartment 410 when the bag 100 is closed. The compartment 410 may have a triangular shape that is complimentary to the shape of the hangers 910 and first end panel 132 of the case 102.

The hanger 910 includes a mating element 912 that removably engages the hanger receiver 302. The mating element 912 of the hanger 910 shown exposed to an exterior 932 of the hanger 910 with a hook 914 of the hanger 910 shown stowed within an interior 930 of the hanger. Notably, the mating element 912, but not the hook 914 of the hanger 910, is what engages and secures the hanger 910 to the hanger receiver 302 within the roller garment bag 100, as shown in FIG. 9A.

In one example, the hanger 910 is configured to convert from premium quality closet hangers to luggage case hanger. The geometry of the mating element 912 and the hanger receiver 302 may be selected to allow less than 20 degrees (±10 degrees), and preferably less than 10 degrees (±5 degrees), of rotation of the hanger 910 in the plane of the hanger 910 within the case 102, thereby supporting the garments so that they don't rotate and crush or rub the shoulders against the inside of the case 102 once closed.

Figure 9B:
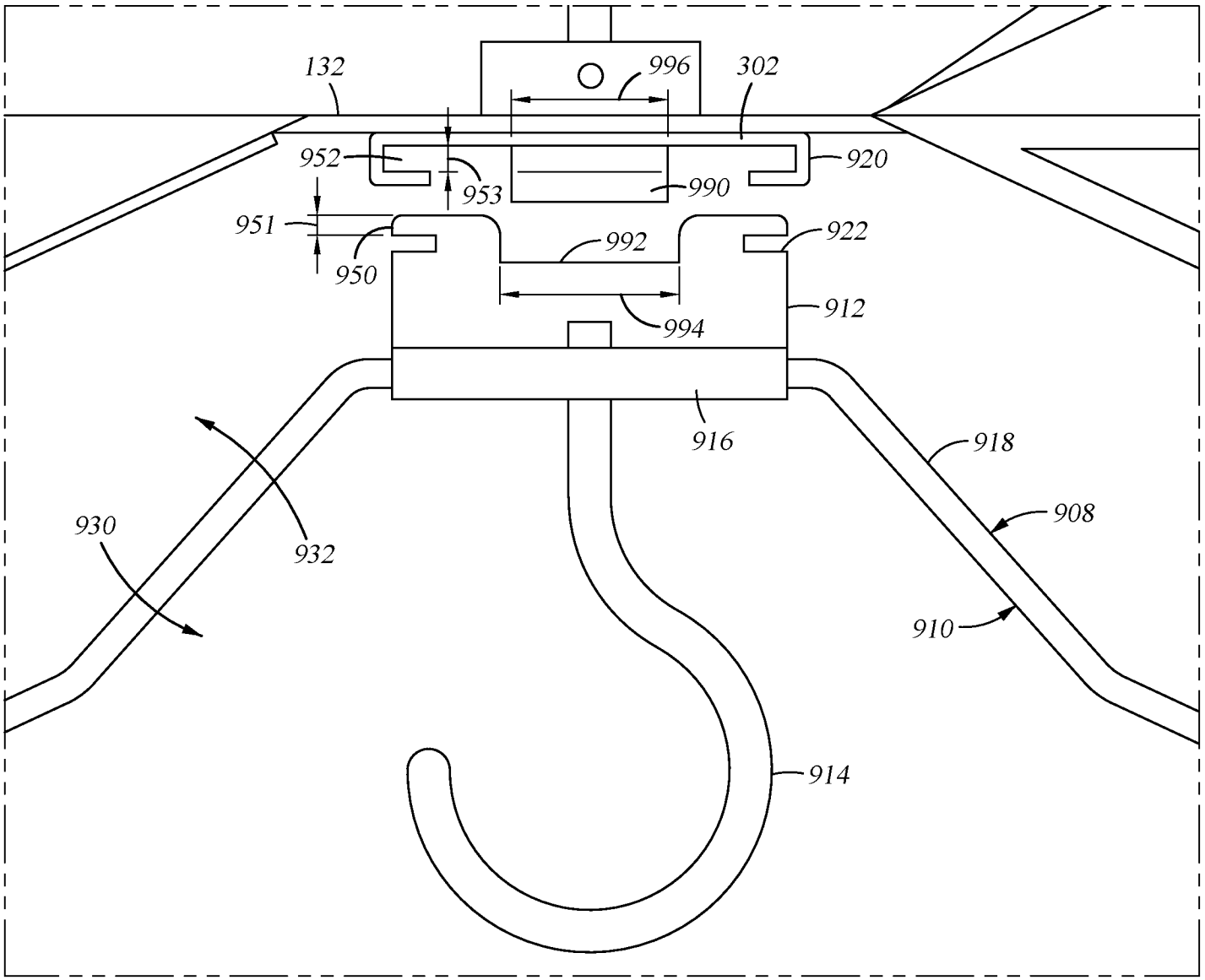

Referring to the enlarged detail of a portion of the hanger 910 illustrated in FIG. 9B, the hanger 910 includes a rotary connector 916 that is coupled to the mating element 912, the hook 914 and the garment supporting portion 908 of the hanger 910. The mating element 912 and the hook 914 are disposed in a common plane, and are coupled to opposite sides of the rotary connector 916. In one example, the mating element 912 is a flat plate that includes slots 922 defined on one side by a lip 950. The slots 922 engage with a C-channel 920 of the hanger receiver 302, while the lip 950 extends into a space 952 bounded by the C-channel 920. Advantageously, a small clearance fit between the height 953 of the C-channel space 952 and the height 951 of the lip 950 may be used to prevent rotation of the hanger 910 disposed on the hanger receiver 302 to less than 20 degrees (±10 degrees), and preferably less than 10 degrees (±5 degrees), within the plane of the hanger 910, thereby supporting the garments so that they don't rotate and crush or rub the shoulders against the inside of the case 102 once closed.

It is contemplated that other configurations for mating the mating element 912 and the hanger receiver 302 may be alternatively utilized.

Figure 9C:
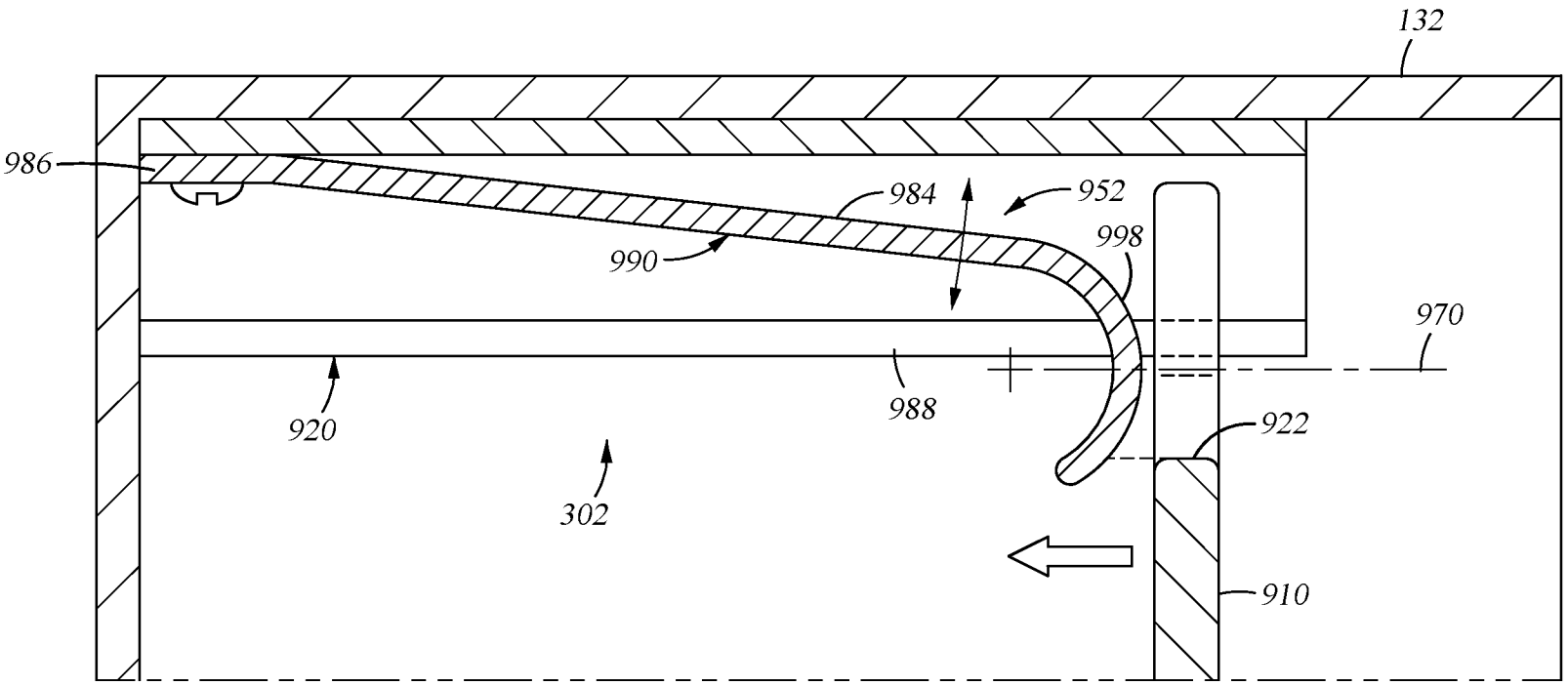

The mating element 912 further includes a recess 992 disposed between the lips 950. The recess 992 engages a clip 990 that is connected to the first end panel 132. The recess 992 has a width 994 that is slightly larger than a width 996 of the clip 990. Thus, when the hanger 910 is slid onto the C-channel 920 of the hanger receiver 302, the clip 990 enters the recess 992 such that the small difference between the widths 994, 996 prevents the mating element 912 of the hanger 910 from rotating to an orientation that would allow the hanger 910 to become disengaged from the C-channel 920 of the hanger receiver 302. In one example depicted in FIG. 9C, the clip 990 has an elongated body 984 spanning between a first end 986 and a second end 998. The first end 986 is coupled to the first end panel 132 or the hanger receiver 302. The second end 998, when the clip 990 is in an unbiased state, is disposed in a position below the bottom surface of the recess 992 in the mating element 912 to prevent hangers 910 from disengaging or sliding out of the hanger receiver 302. The second end 998 is biasable, making it possible to displace the second end 998 of the clip 990 towards the first end panel 132 so that the second end 998 of the clip 990 is above, that is, clear of the bottom surface of recess 992 in the mating element 912 so that hangers 910 may be slid out of the hanger receiver 302. In one example, the clip 990 is fabricated as a spring form. In one example, the second end 998 of the clip 990 is curved and is recessed from the end of the hanger receiver 302, such that when the mating element 912 has already engaged with the hanger receiver 302 while the lip 950 is inserted into the C-channel space 952, the bottom of the recess 922 of the hanger 910 engages the second end 998 of the clip 990 below the center of curvature 970 of the second end 998 so that the clip 990 is pushed up out of the way as the hanger 910 is pushed further back in the hanger receiver 302.

Figure 10:
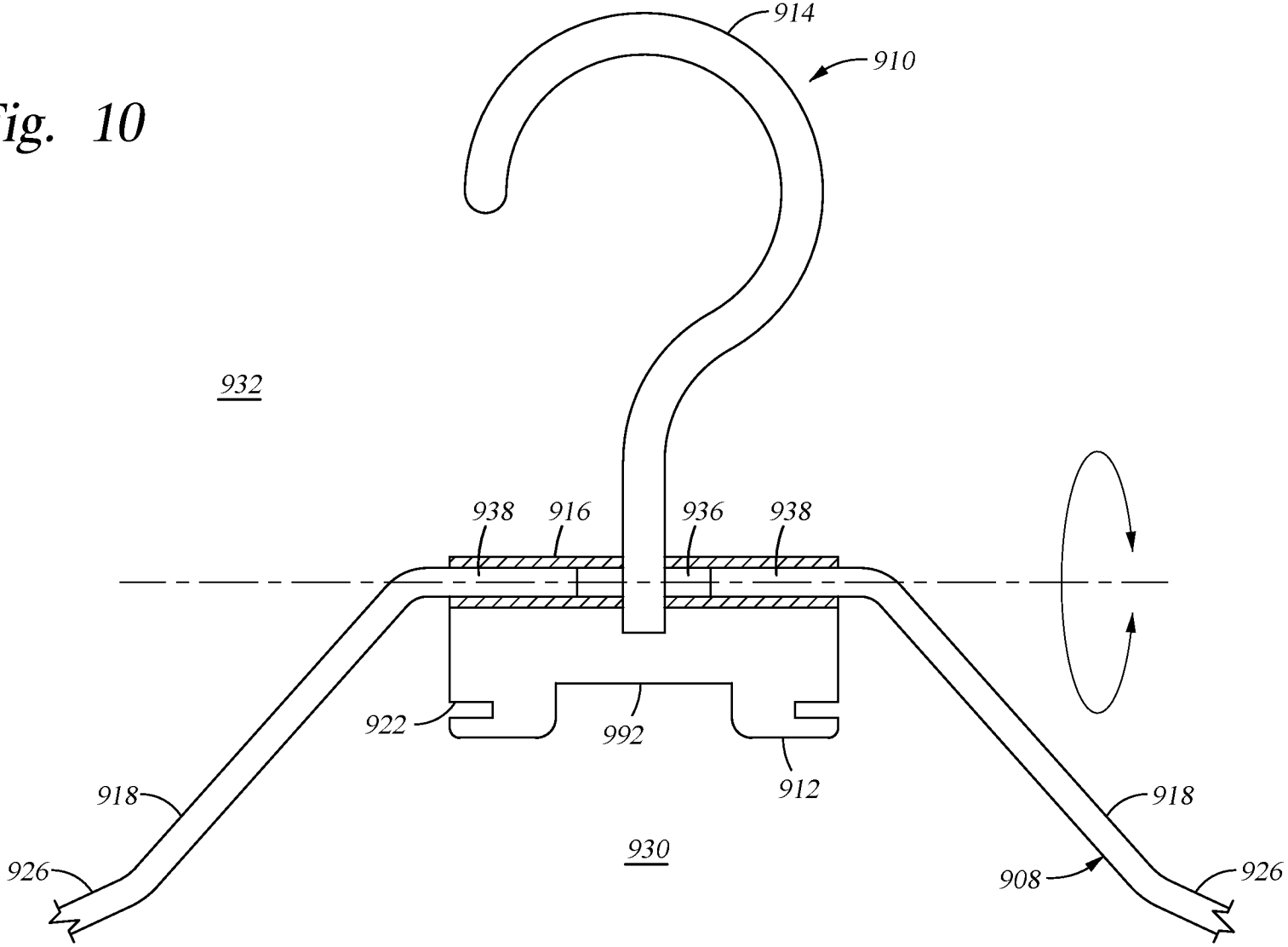
FIG. 10 is a partial enlarged front view of the hanger illustrated in FIG. 9 removed from the roller garment bag and having a hook rotated to the exposed position for use outside of the roller garment bag.

Referring now to FIG. 10, the rotary connector 916 includes a tube 936 configured to receive rod ends 938 of the garment supporting portion 908. The rod ends 938 are rotatable within the tube 936, such that the hook 914 of the hanger 910 may be rotated from the stowed position within the interior 930 of the hanger 910 as shown in FIG. 9A to a ready-to-use position exposed to the exterior 932 of the hanger 910 as shown in FIG. 10. Conversely, rotation of the hook 914 also causes the mating element 912 to rotate from a position ready to engage the hanger receiver 302 as shown in FIG. 9A to a stowed position within the interior 930 of the hanger 910 as shown in FIG. 10.

Continuing to refer to FIGS. 9A, 9B and 10, the garment supporting portion 908 of the hanger 910 includes collar supports 918 and shoulders 926. The shoulders 926 may optionally be connected by a connecting arm 924. The connecting arm 924 may be spaced a distance 942 from the shoulders 926 by shoulder supporting portions 940. The shoulders 926 generally have a shallower angle relative to the collar supports 918 so that the shoulders 926 can support the shoulders of the garment, while the collar supports 918 of the hanger 910 can support the collar of the garment. Furthermore, the shoulder supporting portions 940 of the garment supporting portion 908 are elongated to set the distance 942 to about 3 inches to preferably 5 inches to provide improved support for the garment while in the orientation for transporting the roller garment bag 100, wherein the garments are rotated 90 degrees with respect to their normal orientation on the hanger 910, thus allowing the garment to be transported in a fully supported manner.

Thus, a roller garment bag has been described above that combines and integrates a carry-on and a garment bag into a single luggage case. The roller garment bag includes a garment protecting, U-shaped hanging garment receiving cavity and a packing pouch that is foldable into the garment receiving cavity. The packing pouch is configured to prevent crushing and wrinkling of garment within the cavity, while also staying well clear of garment collars for added protection. Some examples of the roller garment bag also include an offset handle, advantageously allowing the roller bag to be more conveniently towed directly behind a traveler with less chance of hitting obstructions. Other examples of the roller garment bag also include support structure and bag closure designs which enable the bag to be closed by conveniently rolling the support structure over the outstretched flexible portion of the bag which holds the hanging garments, without disturbing the arrangement of the garments or requiring additional restraints on their movement.

While the foregoing is directed to embodiments of the present invention, other and further embodiments of the invention may be devised without departing from the basic scope thereof, and the scope thereof is determined by the claims that follow.

What is claimed is:

1. A roller garment bag comprising:

a U-shaped support structure having a first side panel, a center panel and a second side panel, the first side panel defining a top of the roller bag, the center panel defining a first side of the roller bag and connecting the first and second side panels, and the second side panel defining a bottom of the roller bag;

a flexible panel having a first end and a second end, the first end coupled to a first edge of the center panel, the flexible panel defining a second side and a third side of the roller bag when the flexible panel is disposed around the support structure;

a plurality of wheels extending below the bottom of the roller bag;

a first end panel coupled to the second end of the flexible panel;

a hanger receiver coupled to the first end panel;

a second end panel coupled to a second edge of the center panel, the second edge disposed opposite the first edge, the first and second end panels residing on a fourth side of the roller bag when the flexible panel is disposed around the support structure; and a packing pouch coupled to the second end panel, the packing pouch movable between a position outward of the support structure and a position within the support structure.

2. The roller garment bag of claim 1, wherein the second end panel and the first end panel define the fourth side of the roller bag when the flexible panel is disposed around the support structure.

3. The roller garment bag of claim 1, wherein the packing pouch comprises:

a third end panel coupled by a hinge to the second end panel, the third end panel, the second end panel and the first end panel defining the fourth side of the roller bag when the flexible panel is disposed around the support structure.

4. The roller garment bag of claim 3, wherein an aggregate height of the first, second and third end panels is substantially equal to a height of the first side panel.

5. The roller garment bag of claim 3, wherein the packing pouch comprises:

a pouch end panel coupled by a pouch bottom panel to the third end panel and two pouch side panels which connect with the pouch end panel and the pouch bottom panel and defining an interior of the packing pouch therebetween;

a lip extending from the pouch end panel on a direction parallel to the pouch bottom panel toward the third end panel; and an opening to the interior of the packing pouch defined between the lip and the third end panel.

6. The roller garment bag of claim 1, wherein the packing pouch comprises:

a pouch end panel coupled by a pouch bottom panel to the second end panel and two pouch side panels which connect with the pouch end panel and the pouch bottom panel and defining an interior of the packing pouch therebetween;

a lip extending from the pouch end panel on a direction parallel to the pouch bottom panel toward the second end panel; and an opening to the interior of the packing pouch defined between the two side panels and between the lip and the connection point with the second end panel.

7. The roller garment bag of claim 1, wherein an aggregate height of the first and second end panels is substantially equal to a height of the first side panel.

8. The roller garment bag of claim 1 further comprising:

a telescopic handle coupled to the center panel, wherein a center of the telescopic handle is located off center from the extent of the garment bag on either side of the handle center in the direction transverse to the direction of towing.

9. The roller garment bag of claim 1 further comprising:

a hanger having a first engagement feature configured to slidably mate with a complimentary second engagement feature of the hanger receiver, and wherein first and second engagement features restrict angular movement in a plane of the hanger to less than 20 degrees (+/−10 degrees).

10. The roller garment bag of claim 9, wherein the hanger further comprises:

a garment supporting portion having an upper side and a lower side; and a hanger hook coupled to the first engagement feature, wherein the hanger hook and the first engagement feature are rotatably coupled to the garment supporting portion about an axis which lies within a plane of the hanger, such that the hanger hook and the first engagement feature are movable between the upper and lower sides of the garment supporting portion.

11. The roller garment bag of claim 9, further comprising:

a garment supporting portion having within it two shoulder supporting portions, each of which is not less than 3" in length.

12. The roller garment bag of claim 1 further comprising:

a garment holding strap disposable across the U-shaped support structure and configured to provide a distributed clamping force between the garments and the U-shaped support structure which is substantially constant along its length.

13. The roller garment bag of claim 1, wherein the U-shaped support structure is rigid.

14. The roller garment bag of claim 1, wherein the packing pouch is formed from a rigid material.

15. The roller garment bag of claim 1 further comprising:

a first zipper configured to secure a first side edge of the flexible panel to the first side panel; and a second zipper configured to secure a second side edge of the flexible panel to the second side panel.

16. The roller garment bag of claim 15, wherein two edges of the first side panel have one side of a first zipper associated with them which has a linear portion on the third side of the garment bag and a rounded portion on the second side of the garment bag.

17. A roller garment bag comprising:

a rigid U-shaped support structure having a first side panel, a center panel and a second side panel, the first side panel defining a top of the roller bag, the center panel defining a first side of the roller bag and the second side panel defining a bottom of the roller bag;

a flexible panel having a first end and a second end, the first end coupled to a first edge of the center panel, the flexible panel defining a second side and a third side of the roller bag when the flexible panel is disposed around the support structure;

a first end panel coupled to the second end of the flexible panel;

a hanger receiver coupled to the first end panel;

a second end panel coupled to a second edge of the center panel, the second edge disposed opposite the first edge, the first and second end panels residing on a fourth side of the roller bag when the flexible panel is disposed around the support structure;

a packing pouch coupled to the second end panel, the packing pouch movable between a position outward of the support structure and a position within the support structure, the packing pouch coupled by a hinge to the second end panel;

a latch coupled to first end panel and operable to secure the roller garment bag in a closed state;

a telescopic handle coupled to or adjacent to the center panel; and rollers coupled to the support structure;

a first zipper configured to secure a first side edge of the flexible panel to the first side panel; and a second zipper configured to secure a second side edge of the flexible panel to the second side panel, wherein an edge of the first side panel having a one side of the first zipper having a linear portion on the third side of the garment bag and a rounded portion on the second side of the garment bag.

18. The roller garment bag of claim 17, wherein a center of the telescopic handle is located closer to one side of the garment bag than the other in the direction transverse to the direction of towing.

19. The roller garment bag of claim 17, wherein the packing pouch, when positioned between the first and second side panels of the U-shaped support structure, define a U-shaped garment storage cavity with the center panel of the U-shaped support structure and the flexible panel when the flexible panel is secured to the U-shaped support structure.

20. A method for closing a roller garment bag, the method comprising:

rotating a packing pouch between side panels of a U-shaped support structure to create a U-shaped garment storage cavity within the garment bag, the packing pouch coupled by a hinge to a second end panel, the second end panel coupled between side panels of the U-shaped support structure and also to a center panel of the U-shaped support structure; and securing opposite sides of a flexible panel to the side panels of the U-shaped support structure using zippers, the flexible panel having a first end coupled to the center panel of the U-shaped structure and a second end coupled to a first end panel, the first end panel and the second end panel forming at least a portion of a side of the garment bag, the garment bag having a plurality of wheels.

* * * * *